US006226898B1

(12) United States Patent
Trimble et al.

(10) Patent No.: US 6,226,898 B1
(45) Date of Patent: May 8, 2001

(54) DOWNHILL SKI BOOT WITH DUAL LINER

(75) Inventors: Alan M. Trimble, Laguna Niguel, CA (US); James A. Vandergrift, Seattle, WA (US)

(73) Assignee: K-2 Corporation, Vashon, WA (US)

( * ) Notice: Subject to any disclaimer, the term of this patent is extended or adjusted under 35 U.S.C. 154(b) by 0 days.

(21) Appl. No.: 09/322,206

(22) Filed: May 28, 1999

(51) Int. Cl.[7] ..... A61F 5/14

(52) U.S. Cl. ..... 36/118.2; 36/118.2; 36/117.1; 36/10; 36/119.1

(58) Field of Search ..... 36/117.1, 117.6, 36/117.9, 117.2, 118.2, 119.1, 50.5, 55, 10, 115

(56) References Cited

U.S. PATENT DOCUMENTS 5,050,319 * 9/1999 Perotto et al. ..... 36/117.1
5,435,080 * 7/1995 Meiselman ..... 36/115
5,509,217 * 4/1996 Condini ..... 36/10
5,528,841 * 6/1996 Pozzobon ..... 36/115
5,682,686 * 11/1997 Condini ..... 36/10
5,878,513 * 3/1999 Annovi et al. ..... 36/10
5,901,469 * 5/1999 Saillet ..... 36/118.2
5,933,987 * 8/1999 Demarchi ..... 36/10
6,021,589 * 2/2000 Cagliari et al. ..... 36/117.1

FOREIGN PATENT DOCUMENTS

19527320A * 1/1997 (DE) ..... 36/117.1

* cited by examiner

*Primary Examiner*—Paul T. Sewell
*Assistant Examiner*—Jila Mohandesi
(74) *Attorney, Agent, or Firm*—Christensen O'Connor Johnson Kindness PLLC

(57) ABSTRACT

A downhill ski boot (10) includes an inner shell (14) that is secured within a substantially rigid outer shell (12). The outer shell has a base (18) and an ankle cuff (20). The base includes a sidewall portion (24) having medial and lateral sides, with a longitudinal gap (32) being defined therebetween which exposes the inner shell. The inner shell also receives a removable liner (16). The outer shell may be secured by fasteners to closely conform the inner shell and liner about the foot. The ankle cuff and base are reinforced by a segmented strut to aid in transfer of force from the lower leg to the ski.

33 Claims, 6 Drawing Sheets

DOWNHILL SKI BOOT WITH DUAL LINER

FIELD OF THE INVENTION

The present invention relates to boots for alpine or downhill skiing, and more particularly, to a multilayered downhill ski boot or other glide board boot construction.

BACKGROUND OF THE INVENTION

Speed and directional control in downhill skiing occurs by a skier shifting weight and applying lower leg force through the ball of the foot to the edge of the ski. Accurate and efficient edge control is required for clean turning and stopping. Conventional downhill ski boots include a substantially rigid thermoplastic outer boot that aids this force transmission, limiting medial and lateral flexion of the ankle, while also protecting the skier's ankle.

The rigid outer shell of a conventional ski boot receives an elastomeric foam lining. The lining both thermally insulates the skier's foot, and provides padding for comfort and fit between the skier's foot and the rigid outer shell of the boot. A series of over-center cam buckle straps are provided on the outer shell. The skier's foot is inserted downwardly into the boot, and the straps are then tightened in an attempt to compress the outer shell and the inner liner about the user's foot. Compression is limited, however, by the rigidity of the outer shell. After skiing, the buckles are loosened and the skier's foot is withdrawn upwardly from the boot. Due to the substantially rigid nature of the outer shell, withdrawal of the skier's foot can be difficult.

While conventional downhill ski boots provide adequate protection for a skier's foot, this construction is limited in the ability of the skier to closely conform the rigid outer shell and elastomeric inner lining about the skier's foot. Because the shape of a skier's foot varies from individual to individual, a ski boot tends to fit any given individual tightly in some areas of the foot and lower leg, and loosely in other areas. The ski boot is typically tightly compressed about the skier's shin, while it is inadequately tightened and fitted around other areas such as over the arch of the skier's foot. This is due primarily to the inability to adequately conform and compress the rigid outer shell.

As a result, certain areas of the skier's foot and lower leg receive too much pressure from a conventional ski boot, and may cause discomfort or pain to the skier, particularly during extended use. Likewise, the lack of close fit in other areas of the boot permits movement or slop of the skier's foot within the boot, such as horizontally in lateral and medial directions, during skiing. In order to shift the skier's weight to the ski through the boot, the skier's ball of the foot and toes will often first shift, resulting in less efficient force transmission and loss of a degree of control. Further, as a result of this loose fit, force tends to be applied from the skier's shin to the ski boot and then to the ski. This further increases the degree of pressure exerted on and discomfort to the forward side of the skier's shin.

SUMMARY OF THE INVENTION

The present invention provides a downhill ski boot for receiving a skier's foot and securing it to the heel and toe bindings of a ski. The downhill ski boot includes an inner shell that substantially surrounds a skier's foot. The inner shell is selected to have a predetermined degree of stiffness or flexibility, as selected for given performance levels. The inner shell includes a vamp portion covering the arch of the skier's foot. The downhill ski boot further includes a substantially rigid outer shell that receives the inner shell. The outer shell includes a base having a sole portion that supports the underside of the skier's foot, and a sidewall portion extending upwardly from the sole portion along side at least some regions of the skier's foot. The sidewall portion defines a longitudinal gap between left and right sides of the sidewall portion, over the vamp portion of the inner shell. The base further defines heel and toe binding surfaces for engagement by the heel and toe bindings. The rigid outer shell includes an ankle cuff extending upwardly from the base that is securable about the skier's ankle to aid in maintaining lateral and medial rigidity of the skier's foot. A first compression strap is secured to the base and spans the gap in the sidewall portion, and is fastenable to compress the inner shell about the skier's arch. In a preferred embodiment of the invention, the outer shell and inner shell cooperatively form a compressible, close-fitting shell system, which receives a separate inner lining.

In further aspects of the present invention, the downhill ski boot includes a semirigid tongue guard piece that covers the vamp portion of the inner shell and spans the longitudinal gap in the outer shell. A plurality of compression straps are fastenable over the guard to compress the inner shell for a close fit of the ski boot to a skier's foot, while also drawing the left and right sides of the sidewall portion of the base of the rigid outer shell together.

In a further aspect of the present invention, the compressible inner shell of the downhill ski boot is contoured to project into apertures defined in the substantially rigid outer shell, thereby forming a substantially water tight seal between the inner shell and outer shell.

In a still further aspect of the present invention, the substantially rigid outer shell of the ski boot includes a force transmission reinforcement extending from the ankle cuff to a lower surface of the base. The force transmission reinforcement in the preferred embodiment includes a strut having a first segment integrally molded into the ankle support cuff which abuts a second segment integrally molded into the base, for transmitting force from the skier's leg to the undersurface of the ski boot, beneath the ball of a skier's foot, and to the ski.

In a still further aspect of the present invention, the skier's foot is removable from the downhill ski boot of the present invention forwardly as well as upwardly due to the longitudinal gap defined in the outer shell of the boot, easing removal and placement of the skier's foot.

While the preferred embodiment herein is described as a downhill ski boot, the boot construction of the present invention can also be adapted for use with other glide board boots, such as snow board boots.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
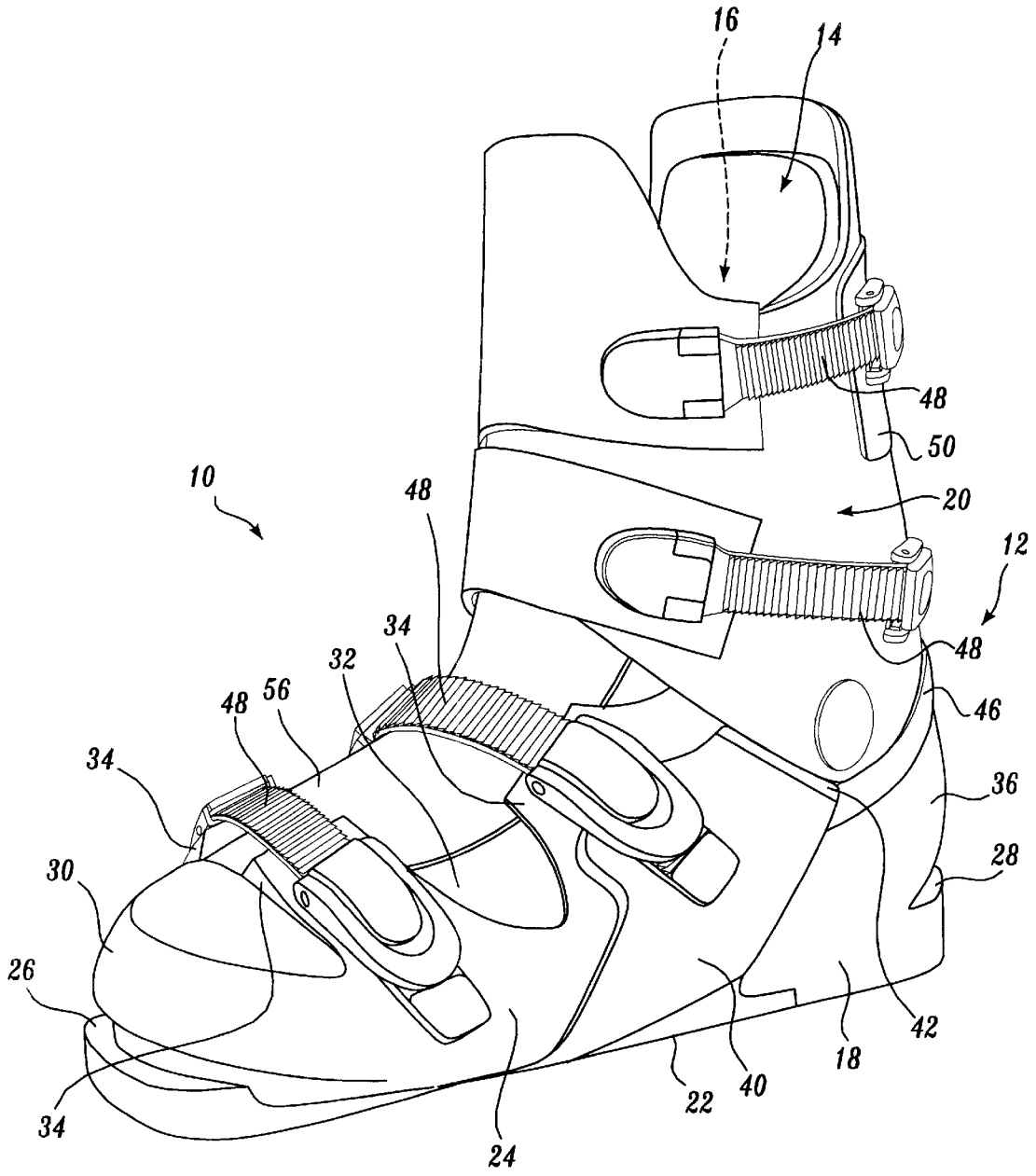
FIG. 1 provides a perspective view of the outer side of a first preferred embodiment of a downhill ski boot constructed in accordance with the present invention.

A first preferred embodiment of the downhill ski boot 10 constructed in accordance with the present invention as shown in FIG. 1. The downhill ski boot 10 includes a substantially rigid outer shell 12, an inner shell 14 received therein, and a cushioned liner 16 received within the inner shell. The outer shell 12 and inner shell 14 cooperatively form a dual shell assembly that supports and closely conforms to the user's foot. The inner lining 16 further cushions the foot and is removable for drying as in a conventional ski boot. The outer shell 12 is constructed from a first material, and the inner shell 14 is constructed from a second material, the second material preferably differing in degree of rigidity than the first material. Preferably, the second material is less rigid than the first material.

Figure 2:
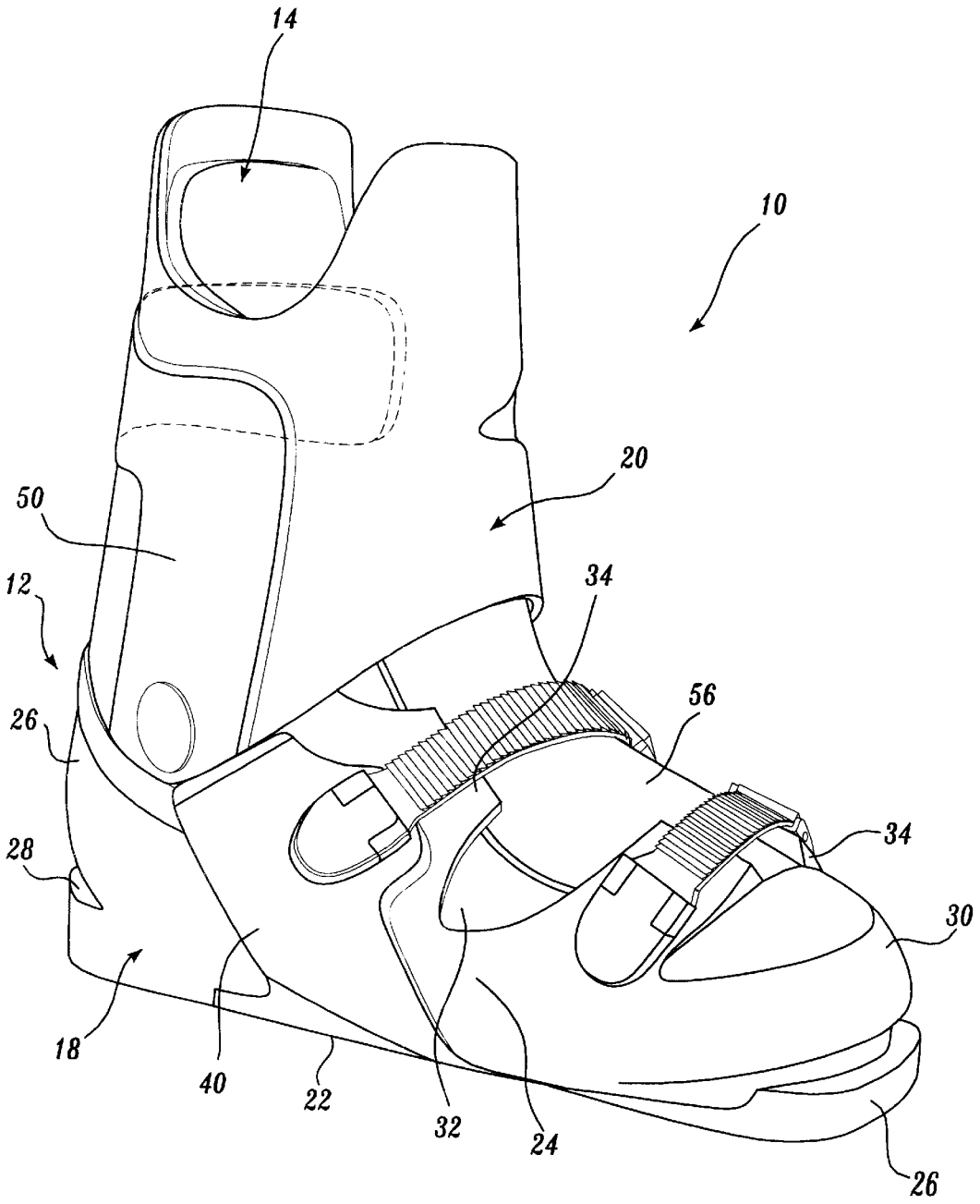
FIG. 2 provides a perspective view of the opposite, inner side of the downhill ski boot of FIG. 1.
Figure 3:
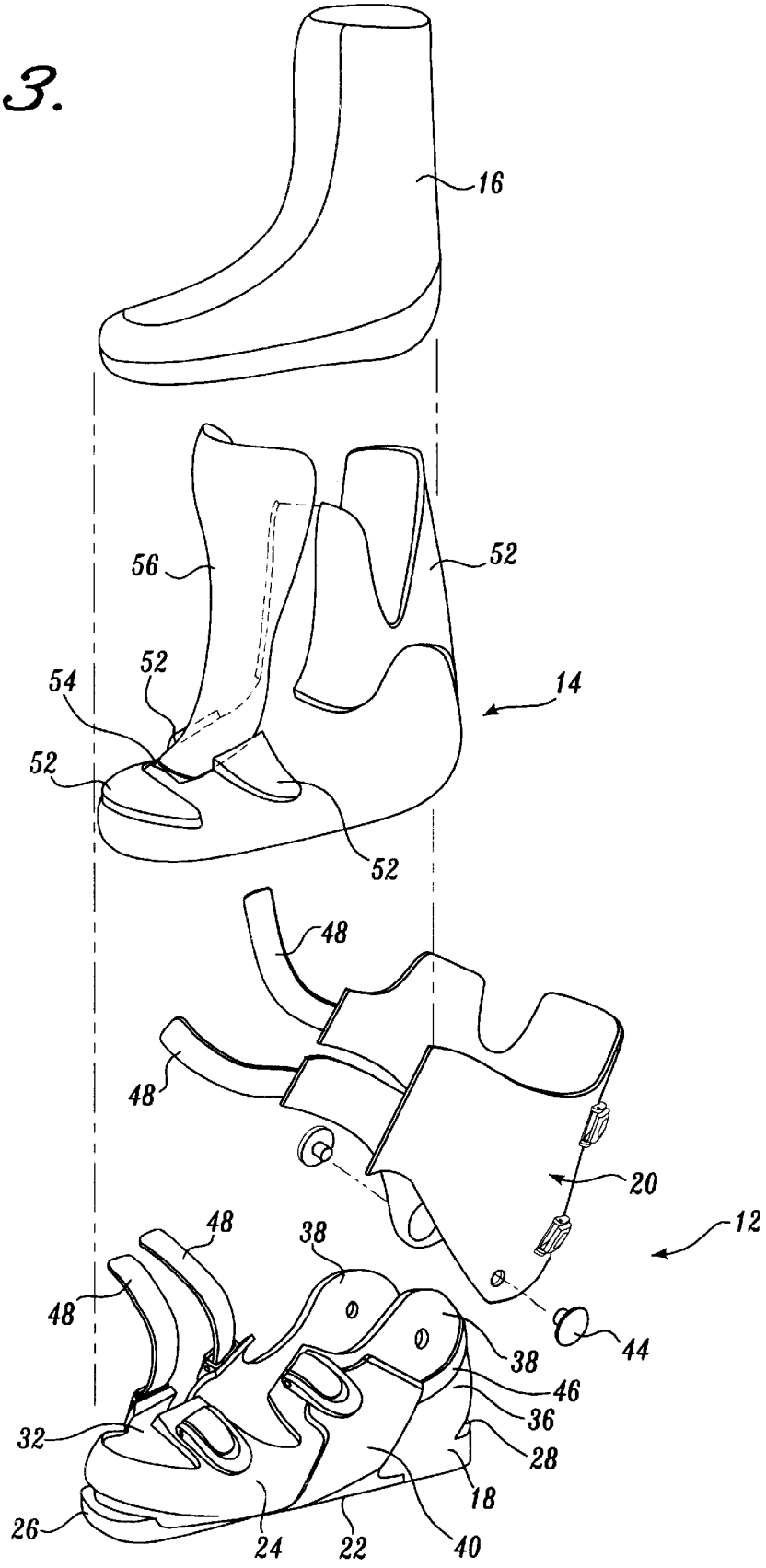
FIG. 3 provides an exploded perspective view of the downhill ski boot of FIG. 1.

Referring to FIGS. 1, 2 and 3, the substantially rigid outer shell 12 includes a base 18 and an ankle cuff 20 that is pivotably secured to the base. The term substantially rigid as used herein refers to a material that is rigid in short lengths of sufficient thickness and has a degree of semirigidity and resiliency in greater lengths or reduced thicknesses. Thus, for example, the base 18 includes a sole portion 22 that underlies and supports a user's foot, which is contoured and has sufficient thickness to be rigid along its longitudinal length during use. The base 18 further includes a sidewall portion 24 projecting upwardly from the perimeter of the sole portion 22, that partially covers the lateral and medial sides of the foot, toe of the foot and heel of the foot, as shall be described further subsequently. The upper extremities of the sidewall portion 24 are thin enough to have a degree of resiliency sufficient to allow the lateral and medial sides of a sidewall portion 24 to be conformed about the inner shell 14 and the user's foot during securement of the boot as shall be described.

Referring now to FIGS. 1 and 3, the sole portion 22 of the base 18 extends longitudinally below a skier's foot, and further extends forwardly and rearwardly to provide toe and heel binding flanges 26 and 28, respectively. The toe and heel binding flanges 26 and 28 engage conventional toe and heel bindings on a downhill ski, in a manner well-known in the art.

The sidewall portion 24 extends upwardly around the perimeter of the sole portion 22. In the forward region of the base 12, the sidewall portion 22 extends upwardly and inwardly to cup the front tip of the skier's toes, defining a toe guard 30. The sidewall also rises upwardly and inwardly on both the inner and outer, i.e., medial and lateral, sides of the skier's foot. However, the sidewall portion 24 covers only lateral and medial sides of the foot, leaving a gap defining a central longitudinal vamp aperture 32 exposed between the lateral and medial sides of the sidewall portion 24. In the embodiment of FIGS. 1–3, the vamp aperture 32 leaves a majority of a vamp portion of the inner shell 14 exposed as well as base 12. The lateral and medial sides of the sidewall portion 24 further include two tabs 34 on each side which extend from the sidewall portion partially across this vamp aperture 32, for the purpose of mounting compression straps as shall be described subsequently. The tabs 34 form a first opposing pair disposed above the ball of the user's foot and a second opposing pair across the vamp.

From the second tab 34, the sidewall portion 34 extends rearwardly and upwardly to define a heel counter 36, that surrounds the heel of the skier's foot completely on the back and sides thereof. In the rear of the base 18, the heel counter 36 terminates below the Achilles tendon. On the lateral and medial sides of the heel counter 36, the sidewall portion 24 extends upwardly to define two radiused mounting portions just below the skier's ankle, as shown in FIG. 3. These side portions 38 are for the purpose of mounting the ankle cuff 20, and shall be described subsequently.

The sole portion 22 and sidewall portion 24 of the base 18 of the outer shell 12 is preferably integrally formed as a one piece unit, such as a one piece molding with a substantially rigid thermoplastic material, such as nylon, or fiber reinforced material, such as carbon reinforced thermosetting or thermoplastic polymer. The base 18 further includes a reinforcing yoke 40 that is integrally molded with the remainder of the base 12, for reinforcement purposes and for transmission, as will be described subsequently. While the preferred embodiment of the base 12 has been illustrated and described as having a one piece unitary construction, it should be readily apparent that the base 12 could be alternately constructed from multiple pieces that are secured together such as by riveting, adhering or bolting. For example, the reinforcing yolk 40 could be riveted, adhered or otherwise secured about the exterior surfaces of the base 18 rather than being integrally molded therewithin.

The yolk 40 spans across the bottom of the base 18, and then extends upwardly and rearwardly therefrom on the lateral and medial sides of the base. The upper edges of the yolk 40 define abutments to which are secured elastomeric shock absorbing stops 42.

The ankle cuff 20 is pivotally secured by pins 44 to the mounting portions 38 of the base 18. The pivot pins 44 are aligned on a transverse axis substantially aligned with the ankle joints of a skier. This permits the ankle cuff 20 to pivot forwardly and rearwardly for flexure of the ankle. Rearward pivoting of the ankle cuff 20 is limited by a raised lip 46 defined across the back of the heel counter 36 of the base 18. The raised lip 46 contacts the lower rear edge of the ankle cuff 20 to define a minimum forward lean angle as is well known for downhill ski boots. When the user flexes forwardly sufficiently from this minimum lean angle, the lower forward edges of ankle cuff 20 abut the shock absorbing stops 42, as shall be described further subsequently, thereby limiting forward lean and permitting force transmission from the lower leg through the ankle cuff 20 to the base 18.

The ankle cuff 20 is preferably formed from the same substantially rigid material as the base 18, and with the base 18 cooperatively defines the outer shell 12. While the ankle cuff 20 has been described as being separately formed from and pivotally connected to the base 18, it should be apparent that the base 18 and ankle sides to permit a predetermined degree of flexion therebetween.

The ankle cuff 20 surrounds the ankle and lower leg of the skier and has overlapping lateral and medial edges. Two conventional over-center cam lock, ratcheting buckle fastener assemblies 48 are provided to fasten and tighten the ankle cuff 20 about the user's lower leg and ankle. Likewise, two conventional over-center cam lock ratcheting strap fastener assemblies 48 are provided on the base 18, mounted on the first and second opposing pairs of tabs 34. As is well known in the art, the fastener assemblies 48 are adjusted by sliding a ratchet strap forward into the mating over-center cam lock buckle for initial adjustment, and then locking the over-center cam lock buckle to finish tightening and secure the strap. The construction of the ski boot of the present invention including an outer shell 12 and an inner shell 14 enables the fastener assemblies 48 to be adjusted for a close fit to the skier's foot, as shall be described further subsequently. While four fastener assemblies 48 have been illustrated in the preferred embodiment, it should be readily apparent to those of skill in the art that an alternate number of fastener assemblies, or different types of fasteners, such as clamps, could be utilized.

The ankle cuff 20 includes a reinforcement strut 50 that cooperates and coacts with the reinforcing yolk 40 of the base 18, as best shown in FIGS. 1 and 2. The reinforcement strut 50 and the reinforcing yolk 40 are suitably made from a fiber reinforced composite, such as carbon fiber reinforced epoxy, or other materials such as KEVLAR™ or glass reinforced resins, or even a metal, such as aluminum or thermoplastics. The reinforcement strut 50 is preferably molded integrally with the ankle cuff 20, but could alternately be secured to the exterior or interior of the ankle cuff 20. The reinforcement strut 50 in the preferred embodiment has an upper transverse portion that wraps around the rear upper side of the ankle cuff 20, and then extends downwardly on the inner (i.e., medial) side of the boot. The reinforcement strut 50 extends downwardly past the corresponding pivot pin 44, terminating on the medial side of the boot at the lower extremities of the ankle cuff 20.

When the ankle cuff 20 is flexed forwardly sufficiently, the lower forward edge of the reinforcement strut 50 abuts against the corresponding shock absorbing stop 42 and thus against the corresponding upper edge of the reinforcing yolk 40 of the base 18. When this contact is made, force is transmitted from the lower leg through the fastened ankle cuff 20 and reinforcement strut 50 downwardly through the reinforcing yolk 40 to the underside of the sole portion 22 of the base 18, below the ball of the foot. Force is thus transmitted readily from the boot in this area to the underlying ski. The shock absorbing stops 42 on either side of the boot prevent chattering between the ankle cuff 20 and the base 18, and absorb shock therebetween during skiing. The reinforcing yolk 40 and reinforcement strut 50 cooperatively comprise a multi-segmented reinforcing strut extending from the lower leg to beneath the ball of the foot. This force transmission enables the remainder of the ski boot 10 to be more lightly constructed and less rigid, for closer conformity and fit to the foot and a higher degree of comfort, while not sacrificing the ability to transmit force from the user's leg to the ski for good edge control.

Attention is now directed to FIG. 3 to further describe the interaction of the outer shell 12 and the inner shell 14. The longitudinal vamp aperture 32 defined in the outer shell 12 spans across the width of the vamp portion of the inner shell 14. The vamp aperture 32 is contoured on either side by the tabs 34 to which the fastener assemblies 48 are mounted. The inner shell 14 is slidably inserted into the outer shell 12, and has an exterior contour that closely conforms to the interior contour of the outer shell 12. The inner shell 14 is detachable secured in place as shall be described further subsequently. The inner shell 14 has thicker portions which define raised regions 52 that conform with apertures defined in the outer shell 12. A first raised region 52 is formed across the upper surface of the toes. Second and third raised regions 52 are formed on lateral and medial sides of the vamp portion of the inner shell 14. These raised regions 52 extend upwardly into correspondingly contoured regions of the longitudinal vamp aperture 32, as shown in FIGS. 1 and 2. The close fit of these raised regions 52 of the inner shell 14 with the contours of the longitudinal vamp aperture 32 of the outer shell 12 ensure that a substantially watertight seal is formed therebetween, to prevent snow and water from entering the interior of the ski boot 10. An additional raised region 52 is formed about the ankle portion of the inner shell 14, to line the interior of the ankle cuff 20 and thereby form a smooth contour of the exterior of the inner shell 14 with the base 18.

The inner shell 14 is suitably formed from a thermoplastic material, selected to have a predetermined degree of flexibility, semirigidity or rigidity to increase (soften) or decrease (stiffen) the overall flex of the boot 10 as desired for a particular application. Flexible thermoplastics, such as a flexible PVC, may be suitably selected to yield a boot with a high degree of flexibility for use by less aggressive skiers. Conversely, a stiff, semi-rigid material such as a Nylon™ polyamide can be selected for a stiffer boot for a higher performance use. The thermoplastic may suitably be lined with a fabric or flexible polymer skin. At least the forward raised regions 52 of the inner shell 14 are layered with or formed from a substantially waterproof material, and preferably the entire inner shell 14 is layered with a substantially waterproof material. Suitable waterproof materials include GORE-TEX™-SYMPATEX® breathable waterproof fabric, or alternately a fabric such as nylon that has been coated with a waterproof or water resistant coating such as urethane. Breathable materials such as GORE-TEX™-SYMPATEX® fabric may be utilized in portions or all of the inner shell 14, to provide for breathability or ventilation of the skier's foot. This aids in keeping the skier's foot drier during use.

Referring again to FIG. 3, the inner shell 14 includes a vamp portion having a tongue 54 that is floating at its lower edge to the remainder of the inner shell 14. The tongue 54 is externally layered with a semi-rigid shield 56, which may be formed with a thermoplastic material such as Nylon™ polyamide. The tongue shield 56 may be formed of the same material as the outer shell 12, but is relatively thin and thus has a higher degree of resilience and flexibility. The tongue shield 56 is contoured to conform to and overlap the tongue 54 of the inner shell 14. When the ski boot 10 is assembled as shown in FIGS. 1 and 2, the tongue shield 56 overlies the tongue of the inner shell 14 and partially covers a center portion of the longitudinal vamp aperture 32. The tongue shield 56 is overlapped by the inner edges of the tabs 34 to which the fastener assemblies 48 are mounted, and extends upwardly substantially the entire height of the ankle cuff 20. Scalloped segments of the longitudinal vamp aperture 32 are not covered by the tongue shield 26, and the inner shell 14 is exposed within these segments of the longitudinal vamp aperture 32. It is these exposed segments which are increased in thickness to define the forward raised regions 52 of the inner shell 14 extend.

Thus, the outer shell 12, inner shell 14, including raised regions 52, and the tongue shield 56 cooperatively encase the foot of the skier and form a substantially watertight seal therearound. However, because of the high degree of adjustability of flexibility or stiffness of the inner shell 14, as well as the ability of the lateral and medial edges of the outer shell to be drawn together, the entire ski boot 10 may be adjusted to closely conform and fit the skier's foot when the fastener assemblies 48 are suitably adjusted.

As shown in FIG. 3, the ski boot 10 is completed by a conventional removable cushioned liner 16, which forms a sock like cushion about the user's foot. The liner 16 may be suitably formed from an elastomeric foam, and can be pulled out of the ski boot 10 to dry after skiing. While the liner 16 of the ski boot 10 is similar to liners used in conventional downhill ski boots, it is supported by the two part ski boot shell formed from the inner shell 14 and outer shell 12, unlike conventional ski boots.

As shown in FIG. 3, the tongue 54 and tongue shield 56 are connected at the lower ends thereof so as to be hingable as well as floating forwardly relative to the remainder of the inner shell 14. This hinged construction, together with the large longitudinal vamp aperture 32, enables the skier to pull the tongue and tongue shield 56 forwardly to readily insert his or her foot into the ski boot 10. Likewise to remove the skier's foot from the ski boot 10, fastener assemblies 48 are loosened and undone, and the skier can again pull the tongue 54 and tongue shield 56 forwardly to withdraw his or her foot both upwardly and forwardly from the ski boot 10. This eases entry and removal of a skier's foot relative to conventional ski boots.

The multi-layered construction of the ski boot 10 also provides for the ability to custom fit the ski boot 10 to an individual user. Either the inner shell 14 or the liner 16 can be replaced with an inner shell or liner having a differing thickness throughout the inner shell or liner, or differing thicknesses at certain points in the inner shell or liner. This then gives the ability to provide a close fit to varying anatomic structures. For instance, as women tend to have a more developed calf than men, a woman's version of the ski boot 10 can be supplied that utilizes the same outer shell 12, but utilizes an inner shell 14 that is thinner in the upper regions so as to accommodate the woman's calf. Likewise a user that has a wide forward foot and a narrow heel, for example, can be fitted with an inner shell 14 that is thicker around the heel region.

To use the ski boot 10, a skier inserts his or her foot into the ski boot, adjusts the fastener assemblies 48 and then locks them into place. This locking of the fastener assemblies 48 pulls the tabs 34 of the outer shell 12 together, compressing the liner 16 and inner shell 14 closely about the skier's foot including the arch region and ball of the foot. Because of resilient and compressible nature of this dual shell construction, a close fit is provided along the skier's entire foot, to minimize horizontal movement of the skier's foot within the ski boot 10, thereby providing for more efficient force transfer during skiing.

Figure 4:
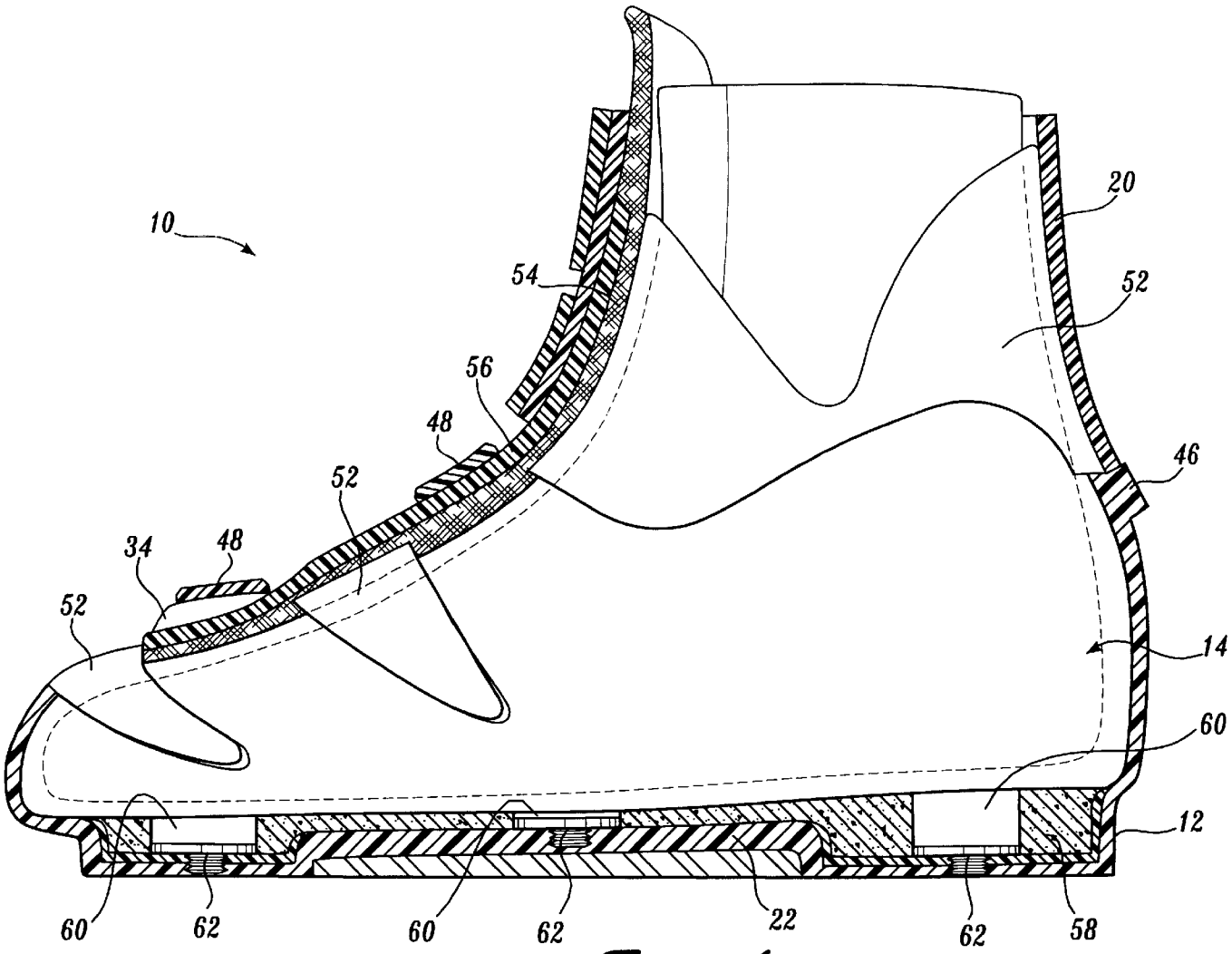
FIG. 4 provides a longitudinal cross sectional view of the outer shell and foot board of the inner shell of the downhill ski boot of FIG. 1, with the remainder of the inner shell not being sectioned to illustrate the contour thereof.

Attention is now directed to FIG. 4 to describe the mounting of the inner shell 14 within the outer shell 12. While the inner shell 14 can be simply slidably mounted within the outer shell 12, or alternately can be permanently fastened within the outer shell 12 such as by an adhesive or riveting, it is preferred that the inner shell 14 be detachably secured within the outer shell 12. The inner shell 14 is reinforced underneath the sole of a user's foot by a structural, substantially rigid foot board 58. The foot board 58 is received within the inner shell 14, and may be adhered in place. The foot board 58 reinforces the rigidity of the sole of the ski boot 10 and is suitably formed from a structural syntactic foam. Alternately, the foot board 58 may be formed from other materials such as compressed fiber board, wood or a non-foamed polymer.

The foot board 58 defines three fastener recesses 60 along its length, suitably beneath the toe region, arch and heel of the foot. The fastener recesses receive threaded fasteners 62 that pass through the foot board 58 and threadedly engage internally threaded inserts that are molded into the sole portion 22 of the base 18 of the outer shell 12. If it is desired to remove the inner shell 14, such as to replace it with a new inner shell 14 for maintenance or to adjust the size of the inner shell 14, the fasteners 62 can be backed out and the entire inner shell 14 can be removed from the outer shell 12. When installed, the fasteners 62 are overlied by the liner 16 to cushion the bottom of the user's foot. Optionally an insole may also be provided between the liner 16 and the foot board 58.

Figure 5:
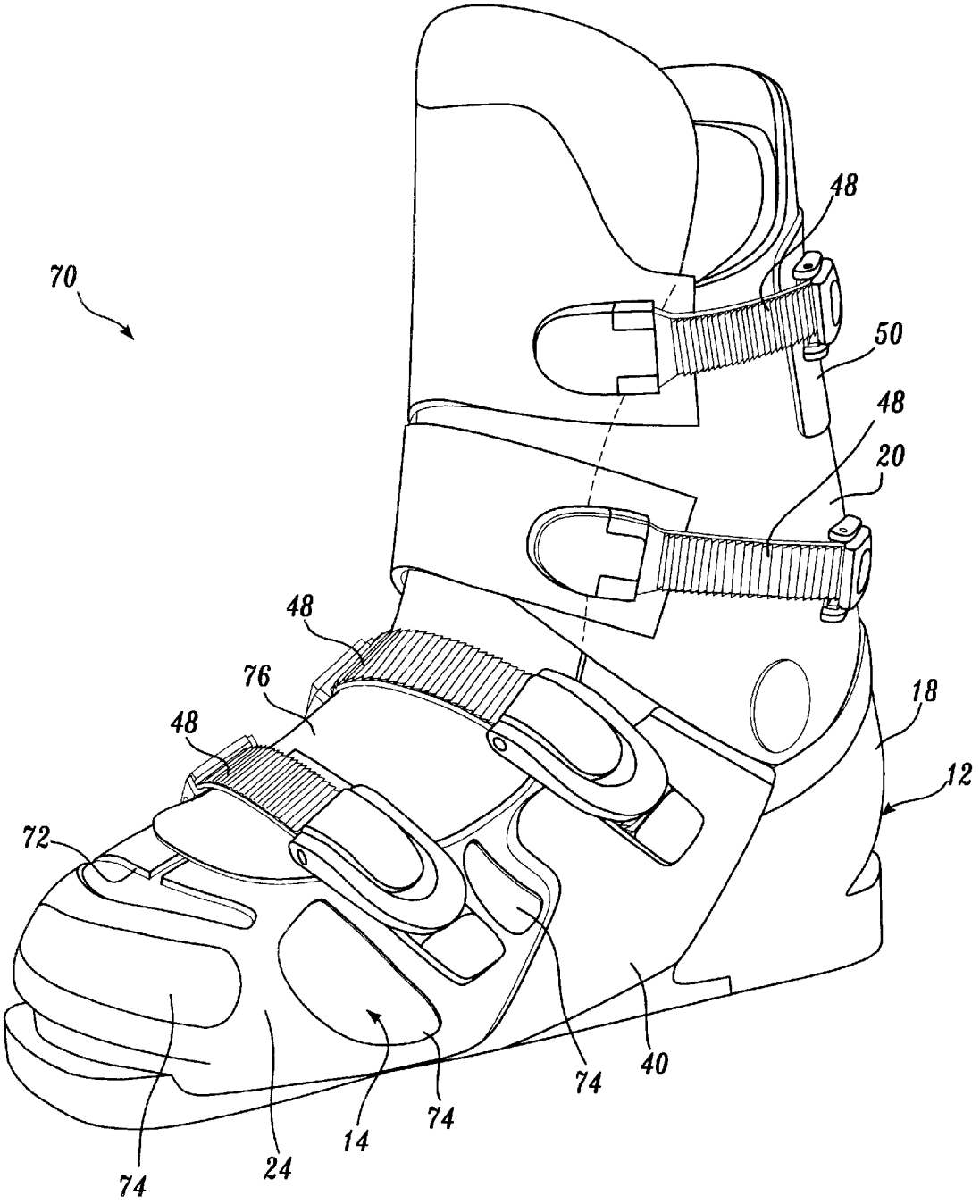
FIG. 5 provides a perspective view of the outer side of a second preferred embodiment of a downhill ski boot constructed in accordance with the present invention.
Figure 6:
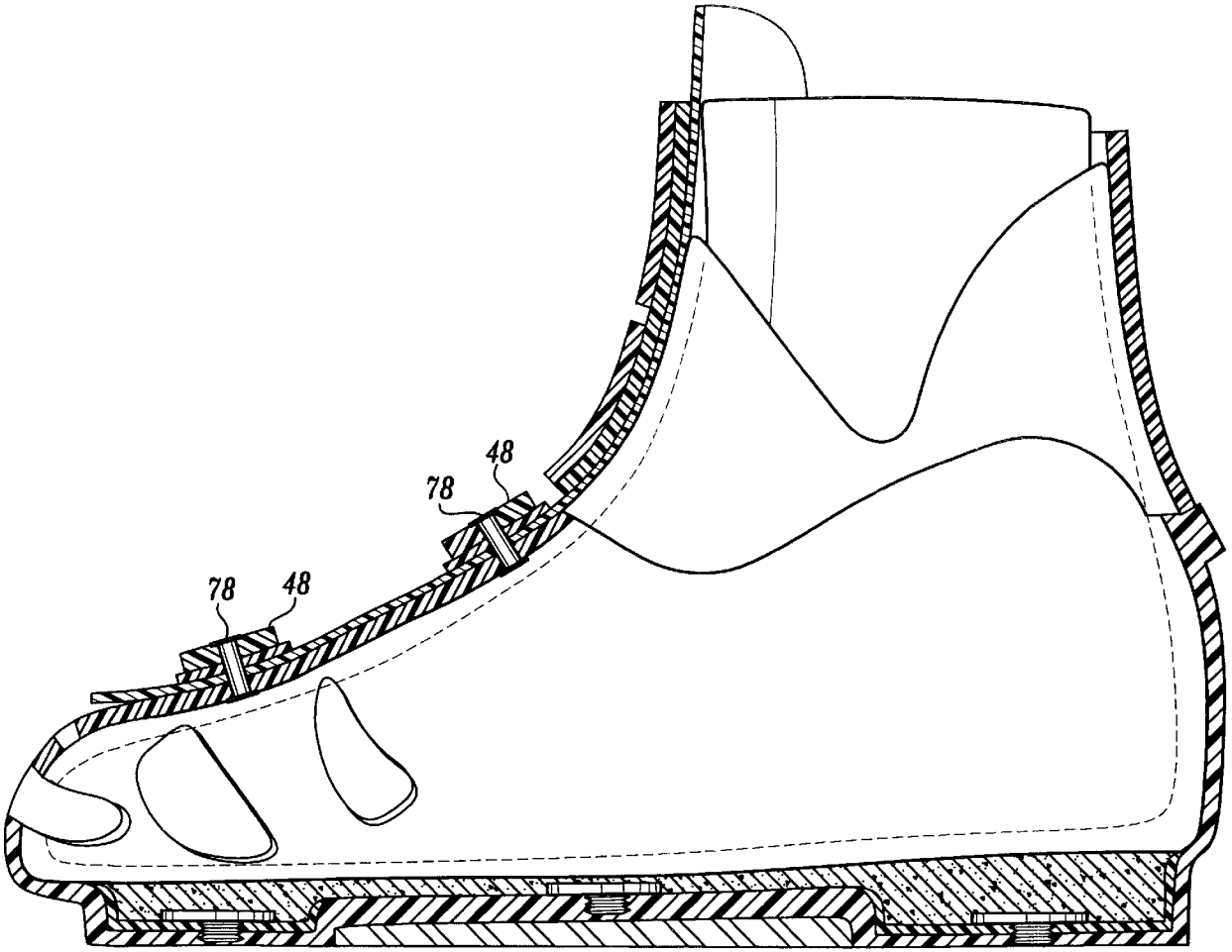
FIG. 6 provides a longitudinal cross sectional view of the outer shell and the foot board of the inner shell of the downhill ski boot of FIG. 5.

An alternate embodiment of the ski boot 70 is shown in FIGS. 5 and 6. The ski boot 70 is identically constructed to the previously described ski boot 10 of FIGS. 1–4, except for the configuration of the vamp aperture and the mounting of the tongue shield and fastener assemblies. Features in common will not be described to avoid repetition, and the same part numbers as used in the first embodiment will be used to refer to corresponding features of the second embodiment. The ski boot 70 thus again includes an outer shell 12 and an inner shell 14 as well as a liner. The outer shell 12 includes a base 18 and an ankle cuff 20 that are reinforced by a reinforcing yolk 40 and a reinforcement strut 50. Suitably two fastener assemblies 48 secure the ankle cuff 24. Additionally two fastener assemblies 48 secure the base 18 of the outer shell 12, but are mounted somewhat differently than in the earlier described embodiment.

Referring to FIG. 5, the ski boot 70 is illustrated in the secured position, in which the ski boot 70 has been tightened about a user's foot for use. The lateral and medial sides of the sidewall portion 24 are slightly spaced apart in this configuration, to define an arch joint 72 extending longitudinally over the arch of the skier's foot. The arch joint is offset slightly from center towards the lateral side of the ski boot. When the fastener assemblies 48 are loosened, this arch joint 72 between the lateral and medial sides of the base 18 spreads apart to define a longitudinal gap between the edges.

Thus in the unfastened, unsecured position (not shown) a gap is defined between the lateral and medial sides of the sidewall portion of the base 18 along the length of the arch, and in a secured position, a predetermined amount of overlap between the sides is provided. This overlap is substantially less than that found in conventional ski boot design, rendering the outer shell 12 far more compressible about the skier's foot. This flexibility and compressibility of the outer shell 12 is further enhanced by a plurality of lateral and medial apertures 74 defined in the outer shell 12, centrally over the toes and on the lateral and medial sides of the outer shell 12 forwardly of and between the fastener assemblies 48. This again exposes the inner shell 14, which preferably includes raised portions which fit within these apertures 74 for sealing engagement.

Another difference between the embodiment of FIG. 5 and that of FIGS. 1–4 is in the mounting of the tongue shield 76. The tongue shield 76 is similar to the previously described tongue shield 56 of the first preferred embodiment. However, in the ski boot 70 of FIG. 5, the tongue shield 76 overlies the outer shell 12, rather than underlying and being overlapped by the outer shell 12. The tongue shield 76 overlaps the arch joint 72 of the outer shell 12. As illustrated in FIG. 6, the tongue shield 76 is fastened in this position by fasteners 78, such as rivets, that pass through the medial ends of the fastener assemblies 48, as well as the medial edge of the tongue shield 76 and the medial side of the outer shell 12. The opposite ends of the fastener assemblies 48 are secured to the lateral side of the outer shell 12. The fastener assemblies 48 thus span across the tongue shield 76, which wraps the outer shell 12 asymmetrically.

This helps to transfer force through the boot to the skier's big toe as the skier flexes forwardly.

As will be apparent to one of ordinary skill in the art based on the disclosure contained herein, the contour of the longitudinal vamp gap and aperture of the previously described embodiments may be adjusted as desired all within the scope of the present invention. Thus the gap provided may be larger or smaller to provide a higher or lower predetermined degree of flexibility of the outer shell.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A downhill ski boot for receiving a skier's foot and securing it to the heel and toe bindings of a ski, comprising:

(a) a shell assembly comprising an inner shell that substantially surrounds a skier's foot, the inner shell including a vamp portion covering the arch of the skier's foot and a substantially rigid outer shell that receives the inner shell, the inner shell and the rigid outer shell forming a shell assembly that cooperatively supports and closely conforms to the skier's foot, wherein the rigid outer shell including:

(i) a base having a sole portion for supporting the underside of the skier's foot and a sidewall portion extending upwardly from the sole portion alongside at least some regions of the skier's foot and defining a longitudinal gap between left and right sides of the sidewall portion over the vamp portion of the inner shell, the base defining heel and toe binding surfaces for engagement by the heel and toe bindings; and (ii) an ankle cuff extending upwardly from the base and securable about the skier's ankle to aid in maintaining lateral and medial rigidity of the skier's foot;

(b) a cushioned liner separable from and received within the inner shell: and (c) a first compression strap secured to the base and spanning the gap in the sidewall portion that is fastenable to compress the inner shell and the liner about the skier's arch.

2. The ski boot of claim 1, wherein the inner shell is constructed from a substantially flexible material.

3. The ski boot of claim 1, wherein the perimeter portion of the base of the rigid outer shell extends substantially around the lateral and medial sides of a skier's foot.

4. The downhill ski boot of claim 3, wherein the perimeter portion of the base of the rigid outer shell further comprises first and second tabs that extend partially over the longitudinal gap between the sides of the sidewall portion, the first compression element being securable across the first and second tabs.

5. The ski boot of claim 4, further comprising third and fourth tabs projecting from the perimeter portion and partially across the longitudinal gap, and a second compression element securable to the base and spanning the longitudinal gap and the third and fourth tabs.

6. The ski boot of claim 1, wherein the inner shell defines a raised portion that aligns with and extends into at least a portion of the longitudinal gap of the rigid outer shell.

7. The ski boot of claim 6, wherein the raised portion of the inner shell and the rigid outer shell cooperatively define a substantially watertight seal.

8. The downhill ski boot of claim 1, wherein the inner shell and the rigid outer shell cooperate to define a substantially watertight seal.

9. The downhill ski boot of claim 1, wherein at least exposed portions of the inner shell comprise a substantially waterproof exterior.

10. The downhill ski boot of claim 1, wherein the ankle cuff is pivotally secured to the base of the rigid outer shell.

11. The downhill ski boot of claim 10, wherein the base of the rigid outer shell defines a heel cup, the ankle cuff being pivotally secured to the heel cup.

12. The downhill ski boot of claim 1, wherein the inner shell comprises a substantially rigid foot board mounted within the inner shell and below a skier's foot.

13. The downhill ski boot of claim 12, wherein the foot board and compressible inner shell are detachably fastened to the rigid outer shell.

14. The downhill ski boot of claim 13, further comprising first and second threaded fasteners for selectively securing the inner shell to the rigid outer shell.

15. The downhill ski boot of claim 12, wherein the foot board comprises structural foam.

16. The downhill ski boot of claim 1, wherein the inner shell is selectively and detachably secured to the rigid outer shell.

17. The downhill ski boot of claim 1, wherein the inner shell comprises a tongue forming a part of the vamp portion of the inner shell.

18. The downhill ski boot of claim 17, wherein the tongue is layered by an external semirigid outer layer.

19. The downhill ski bottom of claim 17, wherein the tongue is hingable forwardly relative to the rigid outer shell, thereby permitting forward and upward removal of the skier's foot from the ski boot.

20. The downhill ski boot of claim 19, wherein the tongue is detachably secured to the inner shell and/or rigid outer shell.

21. The downhill ski boot of claim 1, wherein the outer shell comprises a force transmission reinforcement member extending from along the ankle cuff to below the sole portion of the base.

22. The downhill ski boot of claim 21, wherein the force transmission reinforcement member comprises a strut secured to the rigid outer shell extending upwardly from the base thereof.

23. The downhill ski boot of claim 22, wherein the strut comprises a carbon fiber reinforced composite.

24. The downhill ski boot of claim 22, wherein the strut is integrally molded with the rigid outer shell.

25. The downhill ski boot of claim 22, wherein the strut comprises a first segment secured to the ankle cuff that contacts a second segment secured to the base when the ankle cuff is flexed forwardly.

26. The downhill ski boot of claim 22, wherein the strut extends in a U-shaped configuration under the base of the rigid outer shell and upwardly along lateral and medial sides thereof.

27. The downhill ski boot of claim 1, wherein the gap defined in the sidewall portion of the base leaves a majority of the vamp portion of the inner shell exposed.

28. The downhill ski boot of claim 1, wherein the gap defined in the sidewall portion of the base is open when the first compression strap is unfastened, and closes when the first compression strap is fastened.

29. A downhill ski boot for receiving a skier's foot and securing it to heel and toe bindings of a ski, comprising:

(a) a shell assembly comprising an inner shell for substantially surrounding a skier's foot, the inner shell including a vamp portion covering the arch of the skier's foot, and a substantially rigid outer shell that receives the inner shell, the inner shell and the rigid outer shell forming a shell assembly that cooperatively supports and closely conforms to the skier's foot, wherein the rigid outer shell including a base portion for supporting the underside of the skier's foot and defining heel and toe binding surfaces, the rigid outer shell defining a vamp aperture leaving a substantial portion of the vamp portion of the inner shell exposed;

(b) a cushioned liner separable from and received within the inner shell;

(c) a first compression element secured to the base and spanning the vamp aperture, fastenable to compress the inner shell about the skier's arch; and (d) an ankle support extending upwardly from the base and securable about the skier's ankle to aid in maintaining lateral and medial rigidity of the skier's ankle.

30. A downhill ski boot for receiving a skier's foot and securing it to heel and toe bindings of a ski, comprising:

(a) an inner shell for substantially surrounding a skier's foot, and including a vamp portion covering the arch of the skier's foot;

(b) a cushioned lining slidably received within the inner shell;

(c) a substantially rigid outer shell that receives the inner shell, the inner shell and the rigid outer shell defining mating surfaces that when engaged cooperatively form a substantially watertight encasing about the skier's foot, the rigid outer shell including:

(i) a base including a sole portion for supporting the underside of the skier's foot and a perimeter portion extending upwardly from the sole portion alongside at least some regions of the skier's foot, the base defining heel and toe binding surfaces for engagement by the heel and the bindings; and (ii) an ankle cuff extending upwardly from the base and securable about the skier's ankle to aid in maintaining lateral and medial rigidity of the skier's foot; and (d) a first compression element secured to the rigid outer shell and fastenable to tighten the outer shell and compress the lining and the inner shell about the skier's arch.

31. A downhill ski boot for receiving a skier's foot and securing it to heel and toe bindings of a ski, comprising:

(a) an inner shell for substantially surrounding a skier's foot, and including a vamp portion covering the arch of the skier's foot;

(c) a substantially rigid outer shell that receives the inner shell, the rigid outer shell including:

(i) a base including a sole portion for supporting the underside of the skier's foot and a perimeter portion extending upwardly from the sole portion alongside at least some regions of the skier's foot, the base defining heel and toe binding surfaces for engagement by the heel and the bindings, wherein the perimeter portion of the base defines at least a first aperture and the inner shell defines a raised portion that is sealingly received within the aperture so that the inner shell and the outer shell cooperatively form a substantially watertight encasing about the skier's foot; and (ii) an ankle cuff extending upwardly from the base and securable about the skier's ankle to aid in maintaining lateral and medial rigidity of the skier's foot; and (d) a first compression element secured to the rigid outer shell and fastenable to tighten the outer shell and compress the inner shell about the skier's arch.

32. A downhill ski boot for receiving a skier's foot and securing it to heel and toe bindings of a ski, comprising:

(a) an inner shell for substantially surrounding a skier's foot, and including a vamp portion covering the arch of the skier's foot;

(b) a substantially rigid outer shell that receives the inner shell, the rigid outer shell including:

(i) a base having a sole portion for supporting the underside of the skier's foot and a sidewall portion extending upwardly from the sole portion alongside at least some regions of the skier's foot, the base defining heel and toe binding surfaces for engagement by the heel and toe bindings; and (ii) an ankle cuff extending upwardly from the base and securable about the skier's ankle to aid in maintaining lateral and medial rigidity of the skier's foot;

(c) a first compression element secured to the base and fastenable to compress the inner shell about the skier's arch; and (d) a force transmission strut incorporated into the outer shell and extending from along the ankle cuff downwardly to beneath and crossing over a majority of a width of the base of the rigid outer shell, for linear force transmission from the lower leg of the skier to the sole portion of the base.

33. The downhill ski boot of claim 32, wherein the force transmission strut comprises an upper segment secured to the ankle cuff and a lower segment secured to the base, the upper segment bearing against the lower segment when the ankle cuff is flexed forwardly.

* * * * *

UNITED STATES PATENT AND TRADEMARK OFFICE

CERTIFICATE OF CORRECTION

PATENT NO. : 6,226,898 B1
DATED : May 8, 2001
INVENTOR(S) : A.M. Trimble et al.

It is certified that error appears in the above-identified patent and that said Letters Patent is hereby corrected as shown below:

Title page,
Item [56], References Cited, OTHER PUBLICATIONS, insert in appropriate order the following references:
-- OTHER PUBLICATIONS
Times Mirror Magazines, Inc. *Skiing Trade News Buyer's Guide*, vol. 23, No. 1, cover and advertisements (Feb. 1999).
Times Mirror Magazines, Inc. *Skiing Trade News Show Preview*, cover and pp. 28-36 (Feb. 1999). --

Column 9,
Line 20, "skier's foot and" should read -- skier's foot, and --
Line 40, "shell: and" should read -- shell; and --

Column 10,
Line 30, "ski bottom" should read -- ski boot --

Column 11,
Line 38, "the heel and the" should read -- the heel and toe --
Line 52, "(c)" should read -- (b) --

Column 12,
Line 17, "(d)" should read -- (c) --

Signed and Sealed this

Twenty-second Day of October, 2002

*Attest:*

*Attesting Officer*

JAMES E. ROGAN
*Director of the United States Patent and Trademark Office*